US009677286B2

(12) United States Patent
Ha et al.

(10) Patent No.: US 9,677,286 B2
(45) Date of Patent: Jun. 13, 2017

(54) CONDUCTIVE FLOORING MATERIAL AND A PRODUCTION METHOD THEREFOR

(75) Inventors: Kyungtae Ha, Ulsan (KR); Jae Wan Sung, Ulsan (KR); Sung ha Park, Ulsan (KR)

(73) Assignee: LG HAUSYS, LTD., Seoul (KR)

( * ) Notice: Subject to any disclaimer, the term of this patent is extended or adjusted under 35 U.S.C. 154(b) by 112 days.

(21) Appl. No.: 13/375,345

(22) PCT Filed: Sep. 7, 2010

(86) PCT No.: PCT/KR2010/006057

§ 371 (c)(1),
(2), (4) Date: Nov. 30, 2011

(87) PCT Pub. No.: WO2011/037338

PCT Pub. Date: Mar. 31, 2011

(65) Prior Publication Data

US 2012/0070646 A1 Mar. 22, 2012

(30) Foreign Application Priority Data

Sep. 25, 2009 (KR) ..... 10-2009-0091329

(51) Int. Cl.
*B32B 5/00* (2006.01)
*E04F 15/10* (2006.01)

(52) U.S. Cl.
CPC ..... *E04F 15/107* (2013.01); *E04F 15/102* (2013.01); *E04F 2290/048* (2013.01);
(Continued)

(58) Field of Classification Search
CPC ..... E04F 15/102; E04F 15/107; E04F 15/10; E04F 15/12; H01B 1/12; C08F 2/46;
(Continued)

(56) References Cited

U.S. PATENT DOCUMENTS 4,690,851 A * 9/1987 Auduc et al. ..... 428/116
5,928,735 A * 7/1999 Padmanabhan et al. ..... 428/33
(Continued)

FOREIGN PATENT DOCUMENTS

CN 101080370 A 11/2007
JP 63-112777 * 5/1988
(Continued)

OTHER PUBLICATIONS

Chinese Patent Application No. 201080021896.1, Office Action dated Aug. 13, 2015, seven (7) pages.

*Primary Examiner* — Camie Thompson
(74) *Attorney, Agent, or Firm* — Nath, Goldberg & Meyer; Jerald L. Meyer; Christopher Thomas

(57) ABSTRACT

The present invention relates to a conductive flooring material containing a conductive deformation-preventing layer containing conductive fibers comprising glass fibers and carbon fibers, and to a production method therefor. The present invention can provide a conductive material which is useful not only in the form of tiles but also in the form of long sheets because the conductive fibers comprise glass fiber and carbon fiber impart not only outstanding electrical conductivity but also stable deformation-preventing properties.

8 Claims, 1 Drawing Sheet

(52) U.S. Cl.
CPC ..... *Y10T 428/249924* (2015.04); *Y10T 428/249949* (2015.04)

(58) Field of Classification Search
CPC ..... B32B 2471/00; B32B 2307/554; H05F 3/025; Y10T 428/249945; Y10T 428/249946
See application file for complete search history.

(56) References Cited

U.S. PATENT DOCUMENTS

| | | | | |
|---|---|---|---|---|
| 2002/0127372 | A1* | 9/2002 | Waite et al. | 428/172 |
| 2004/0166347 | A1* | 8/2004 | Nieminen | 428/500 |
| 2007/0108421 | A1* | 5/2007 | Stokki et al. | 252/500 |
| 2009/0193747 | A1* | 8/2009 | Chorney et al. | 52/583.1 |
| 2009/0226662 | A1* | 9/2009 | Dyczko-Riglin et al. | 428/95 |
| 2010/0009170 | A1* | 1/2010 | Wedel et al. | 428/328 |
| 2011/0305886 | A1* | 12/2011 | Phan | B32B 9/02 428/201 |

FOREIGN PATENT DOCUMENTS

| | | | |
|---|---|---|---|
| JP | 63-112777 | A | 5/1988 |
| JP | 4-30507 | B | 5/1992 |
| JP | 6-47483 | U | 6/1994 |
| JP | 2000-1977 | A | 1/2000 |
| JP | 2001-011243 | A | 1/2001 |
| KR | 10-0517171 | * | 5/2004 |
| KR | 10-2004-0053487 | A | 6/2004 |
| KR | 10-2004-0074690 | * | 8/2004 |
| KR | 10-0517171 | B1 | 9/2005 |
| RU | 2310935 | C2 | 11/2007 |
| RU | 2365067 | C2 | 8/2009 |
| WO | 2009/018960 | A1 | 2/2009 |

* cited by examiner

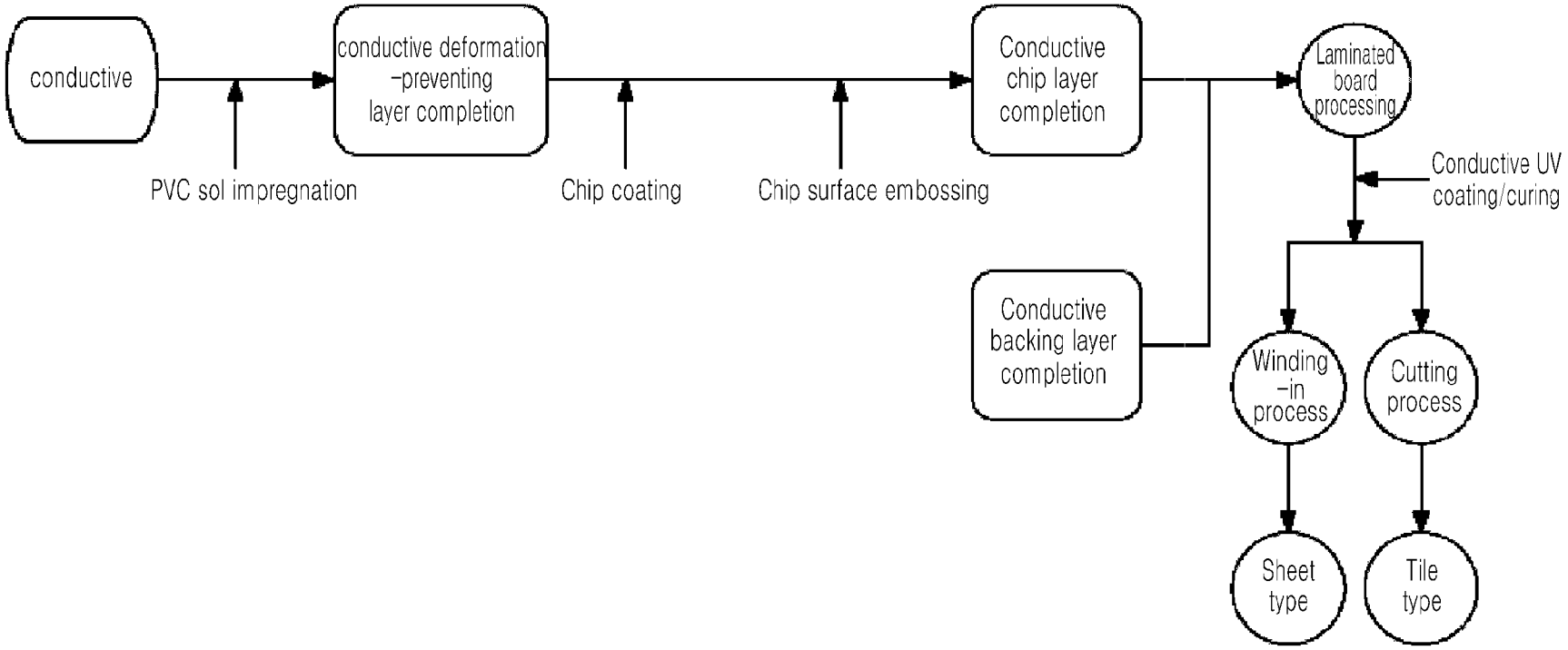
conductive
PVC sol impregnation
conductive deformation -preventing layer completion
Chip coating
Chip surface embossing
Conductive chip layer completion
Conductive backing layer completion
Laminated board processing
Conductive UV coating/curing
Winding -in process
Cutting process
Sheet type
Tile type

CONDUCTIVE FLOORING MATERIAL AND A PRODUCTION METHOD THEREFOR

This is a National Phase Application filed under 35 U.S.C. 371 as a national stage of PCT/KR2010/006057, filed on Sep. 7, 2010, an application claiming the benefit from Korean Application No. 10-2009-0091329 filed on Sep. 25, 2009, the entire content of each of which is hereby incorporated by reference.

TECHNICAL FIELD

The present invention relates to a conductive flooring material and a method of production thereof.

BACKGROUND

Electron static discharge (ESD) generally results in a merely unpleasant sensation to the human body, but it can be very damaging to electronic devices, thereby causing the malfunction thereof, and internal circuit damage, etc.

Also, ESD brings about the problem of pollution, such as fine floating particles, in semiconductor devices, which results in faulty semiconductor chips.

In order to overcome such a problem, antistatic or conductive flooring materials are used in clean rooms, electronic device assembly, laboratories, areas for installing computer and other electronic devices, and medical equipment. Also, conductive flooring materials are increasingly used in areas in which there is a danger of fire or explosion.

Conventionally, the conductive flooring materials can have improved properties, i.e., reduced electrical resistance, by the use of a conductive plasticizer and conductive carbon.

The conductive plasticizer can be used to enhance the electrical conductivity of the flooring materials to provide easy product preparation and various product appearances. However, it is expensive and its migration is occurred, which is difficult to retain its properties for a long-term period.

Meanwhile, although the conductive carbon is cheap and its migration is not occurred, it has problems of difficulty in preparation of products and providing good appearance due to its inherent black color.

SUMMARY

The present invention endeavors to overcome such problems according to the prior art, and accordingly, it provides some embodiments of a conductive flooring material having markedly improved electrical conductivity and stable deformation-preventing properties, and a method of production thereof.

According to one embodiment of the present invention, provided is a conductive flooring material containing a conductive deformation-preventing layer containing conductive fibers comprising glass fibers and carbon fibers.

According to another embodiment of the present disclosure, provided is a method for producing the conductive flooring material according to the present invention, which includes a first step of impregnating a polymer resin sol in conductive fibers comprising glass fibers and carbon fibers.

BRIEF DESCRIPTION OF THE DRAWINGS

FIG. 1 is a process flow chart schematically illustrating a method for producing the conductive flooring material according to one embodiment of the present invention.

DETAILED DESCRIPTION

The present invention refers to a conductive flooring material containing a conductive deformation-preventing layer containing conductive fibers comprising glass fibers and carbon fibers.

The conductive flooring material according to the present invention will be more specifically described herein below.

As mentioned above, the conductive flooring material according to the present invention contains a conductive deformation-preventing layer containing conductive fibers comprising glass fibers and carbon fibers.

The conductive fibers are formed by combining glass fibers having stable deformation-preventing properties with carbon fibers having good electrical conductivity. Thus, the conductive fibers may include any type of fibers having stable deformation-preventing properties and good electrical conductivity, but are not limited thereto.

Also, the glass fibers and the carbon fibers comprised in the conductive fibers is not particularly limited by an amount thereof, for example, the conductive fibers may comprise the carbon fibers in an amount of 3 parts by weight to 30 parts by weight based on 100 parts by weight of the glass fibers. When the conductive fibers comprise the carbon fibers in an amount of less than 3 parts by weight based on 100 parts by weight of the glass fibers, electron static discharge may occur due to the poor appliance of electric current in a direction of left-to-right or top-to-bottom. When the conductive fibers comprise the carbon fibers in an amount of more than 30 parts by weight based on 100 parts by weight of the glass fibers, the carbon fiber may be poorly distributed to cause the uneven surface of the glass fibers or fiber materials.

Meanwhile, the conductive fibers may comprise a polymer resin impregnated therein. The polymer resin impregnated in the conductive fibers may be a resin having good durability, processability and stain resistance and an attractive appearance, and the examples of the polymer resin may include one or more selected from the group consisting of polyvinyl chloride resin, acryl resin, polyester resin, polystyrene resin, polytetrafluoroethylene, rubber, ethylene vinyl acetate copolymer and ethylene propylene copolymer, but is not limited thereto. Specifically, polyvinyl chloride resin, ethylene vinyl acetate copolymer and ethylene propylene copolymer may be used alone or in a mixture thereof. More specifically, polyvinyl chloride resin may be used.

The polyvinyl chloride resin is used as a material for various molded articles such as films, sheets, pipes, boards, flooring, electric wire coating, toys and convenience goods. Particularly, soft polyvinyl chloride resin which is combined with a plasticizer may improve molding processability and colorability, and thus, it has improved decorativeness and can be widely used as the vinyl glass of a wallpaper in a building material industry, and a flooring material.

The polyvinyl chloride resin which is used in the present invention may include any one of resins prepared from a monomer such as vinyl chloride by a conventional polymerization, for example, suspension polymerization, bulk polymerization and emulsion polymerization which is well-known in the art. Also, it may be a copolymer of vinyl chloride as a main component with a comonomer such as acrylic acid ester, ethylene, propylene and chloride vinylidene.

Meanwhile, the conductive flooring material according to the present invention may further include a conductive chip layer which is formed on the conductive deformation-preventing layer and comprises a carbon chip and a colored chip.

The term "carbon chip" used herein is a conductive chip prepared by grinding a cured polymer resin comprising carbon, and its type is not particularly limited. Accordingly, it may include any conductive chip comprising carbon. Also, the term "colored chip" used herein is a chip having a certain color so as to exhibit a fine appearance and may include any color chip which is conventionally used in the art.

Furthermore, the conductive chip layer may comprise the carbon chip in an amount of 5 parts by weight to 30 parts by weight based on 100 parts by weight of the colored chip. When the conductive chip layer comprises the carbon chip in an amount of less than 5 parts by weight based on 100 parts by weight of the colored chip, its electrical conductivity may be insufficient. When the amount of the carbon chip is more than 30 parts by weight based on 100 parts by weight of the colored chip, the embodiment of fine appearance may be relatively difficult.

Also, the conductive flooring material according to the present invention may further include a conductive UV coating layer which is formed on the conductive chip layer and contains the cured product of a photocurable resin composition comprising conductive particles.

The conductive particles comprised in the photocurable resin composition are micro-sized particles having conductivity, and their type and size are not particularly limited. For example, the conductive particles may include carbon nanotubes, antimony-doped tin oxide (ATO), indium-doped tin oxide (ITO), antimony-doped zinc oxide (AZO) and etc, and have an average particle diameter ranging from 5 nm to 200 nm.

Also, the photocurable resin composition may include a photocurable acrylate oligomer, a reactive diluents and a photoinitiator which are conventionally used in the art, but is not limited thereto.

For example, the photocurable acrylate oligomer may be one or more selected from polyester acrylate oligomer, epoxy acrylate oligomer or urethane acrylate oligomer which are conventionally used in the art.

Also, the reactive diluent may be monofunctional or multifunctional acrylate monomer which is conventionally known in the art. The examples of monofunctional acrylate monomer may include one or more selected from the group consisting of methyl(meth)acrylate, ethyl(meth)acrylate, 2-ethylhexyl(meth)acrylate, oxyl(meth)acrylate, dodecyl (meth)acrylate, octadecyl(meth)acrylate, 1,2-propyleneglycol(meth)acrylate, 1,3-propyleneglycol(meth)acrylate, methylcyclohexyl(meth)acrylate, isobornyl(meth)acrylate, phenyl(meth)acrylate, benzyl(meth)acrylate, chlorophenyl (meth)acrylate, methoxyphenyl(meth)acrylate, bromophenyl(meth)acrylate, stearyl(meth)acrylate, tetrahydrofuryl (meth)acrylate, hydroxyethyl(meth)acrylate, hydroxypropyl (meth)acrylate, glycidylmethacrylic acid epoxy(meth) acrylate and ethoxy ethoxy ethyl(meth)acrylate, but is not limited thereto.

Also, the examples of the multifunctional monomer may include one or more selected from the group consisting of ethylene glycol di(meth)acrylate, methylpropanediol di(meth)acrylate, 1,3-butanediol di(meth)acrylate, 1,4-butanediol di(meth)acrylate, 1,5-pentanediol di(meth)acrylate, 1,6-hexanediol di(meth)acrylate, neopentyl glycol di(meth)acrylate, diethylene glycol di(meth)acrylate, triethylene glycol di(meth)acrylate, dipropylene glycol di(meth)acrylate, tripropylene glycol di(meth)acrylate, trimethylolpropane tri (meth)acrylate, ethoxylated trimethylolpropane tri(meth) acrylate, propoxylated trimethylolpropane tri(meth)acrylate, glycerine tri(meth)acrylate, pentaerythritol tri(meth)acrylate, pentaerythritol tetra(meth)acrylate, dipentaerythritol hexa(meth)acrylate and polyethylene glycol di(meth)acrylate, but is not limited thereto.

Meanwhile, the photoinitiator may be any one which is conventionally used in the art. For example, the photoinitiator may include one or more selected from the group consisting of benzophenone-based photoinitiator, ketal-based initiator, acetophenone-based initiator and hydroxy alkylphenol-based initiator, but is not limited thereto.

The conductive particles, photocurable acrylate oligomer, reactive diluents and photoinitiator comprised in the photocurable resin composition are not particularly limited for their amount and may be used in an amount, which is known in the art, suitable to form a UV coating layer having conductivity on the surface of the flooring material.

Furthermore, the conductive flooring material according to the present invention may further include a conductive wax layer formed on the conductive chip layer, as well as the conductive UV coating layer.

The conductive wax layer is formed by coating a wax having conductivity. The example of the wax is a wax containing the conductive particles as mentioned above and may include any wax exhibiting conductivity known in the art, without particular limitation for its type.

The conductive particles and wax contained in the conductive wax layer are not particularly limited for their amount and may be used in an amount suitable to embody the object of the present invention.

Additionally, the conductive flooring material according to the present invention may further include a conductive backing layer comprising carbon materials, which is formed on the back side of the conductive deformation-preventing layer.

The conductive backing layer formed in the back side of the conductive deformation-preventing layer can prevent the flooring material from distorting and retain the entire balance of the flooring material. Any material comprising carbon materials and having electrical conductivity may be used in the conductive backing layer, regardless of the type of carbon materials.

More specifically, the carbon materials may be one or more selected from the group consisting of natural crystalline graphite, natural amorphous graphite, synthetic graphite, carbon fiber, carbon black and graphite.

The conductive backing layer may comprise a polymer resin together with the carbon material as mentioned above, and the polymer resin may use the same one as the resin impregnated in the conductive fibers comprised in the conductive deformation-preventing layer as mentioned above.

The polymer resin and carbon materials comprised in the conductive backing layer are not particularly limited by their amount. For example, the carbon material may be used in an amount of 10 parts by weight to 300 parts by weight based on the 100 parts by weight of the polymer resin.

The conductive flooring material according to the present invention has good electrical conductivity. The electrical resistance of the conductive flooring material may be $10^3$ to $10^{10}\Omega$, preferably $10^3$ to $10^8\Omega$, more preferably $10^3$ to $10^5\Omega$, but is not limited thereto.

When the electrical resistance of the conductive flooring material is less than $10^3\Omega$, the flooring material may be changed to a conductor, thereby causing a spark, shock, electric shock, etc. The electrical resistance of more than $10^{10}\Omega$ may cause electron static discharge.

Also, the conductive flooring material according to the present invention has stable deformation-preventing properties, as well as good electrical conductivity as mentioned above. The stable deformation-preventing properties of the conductive flooring material is not particularly limited, for example, the conductive flooring material may have a dimensional change ratio of 0.1% or less, preferably 0.05% or less, which is measured after exposure to a temperature of 80° C. for 6 hours.

As mentioned above, the conductive flooring material according to the present invention may have a dimensional change ratio of 0.1% or less to retain a stable dimension, have good smoothness to facilitate convenience in construction and surprisingly improve the stable deformation-preventing properties of a product after construction.

The dimensional change ratio of the flooring material may be measured by using an instrument and a method which are conventionally known in the art, without a particular limitation. For example, the dimensional change ratio may be obtained by measuring the dimension change for the conductive flooring material after placement for 6 hours in a dry oven which is adjusted to 80° C.

Thus, the conductive flooring material according to the present invention has stable deformation-preventing properties and good electrical conductivity to be effectively used in the form of a long sheet type which is desired for the construction and maintenance of a product, as well as a tile type.

Furthermore, the present invention provides a method for producing the conductive flooring material according to the present invention, which comprises a first step of impregnating a polymer resin sol in conductive fibers comprising glass fibers and carbon fibers.

In the method for producing the conductive flooring material according to the present invention, the first step is to impregnate a polymer resin sol in conductive fibers comprising glass fibers and carbon fibers to obtain a textile and prepare a conductive deformation-preventing layer from the textile obtained.

The textile may be subjected to a winding-in process to prepare a conductive flooring material in the form of a long sheet having a thickness and width conventionally desired in the art. The long sheet-type textile may be cut to prepare a conductive flooring material in the form of tile.

The conductive deformation-preventing layer thus obtained has good electrical conductivity and stable deformation-preventing properties to effectively preventing electron static discharge, and it may be prepared in a long sheet type to provide convenience in construction and maintenance.

Also, the method for producing the conductive flooring material according to the present invention may further include a second step of scattering a conductive chip on the conductive deformation-preventing layer obtained in the first step; and a third step of thermally compressing the conductive chip scattered in the second step.

That is, the conductive chip comprising the carbon chip and the colored chip as mentioned above may be scattered on the conductive deformation-preventing layer obtained in the first step, and the scattered conductive chip may be integrally formed on the conductive deformation-prevention layer by a thermal compression process.

Additionally, the method for producing the conductive flooring material according to the present invention may further include a forth step of coating a photocurable resin composition comprising conductive particles on the conductive chip layer obtained in the third step; and a fifth step of UV-irradiating the composition coated in the forth step to be cured.

In the forth step, the photocurable resin composition comprising conductive particles may be coated by using a method known in the art, for example, spray coating, gravure coating, roll coating and bar coating, but is not limited thereto.

Also, the thickness of the photocurable resin composition coated on the conductive chip layer by said coating processes may be, for example, 5 μm to 10 μm, but is not limited thereto. When the thickness of the photocurable resin composition coated is less than 5 μm, pure water is removed to decrease the thickness of the composition, resulting in the difficulty in retaining antistatic properties and the failure to the complete formation of a coating film. When the thickness of the photocurable resin composition coated is more than 10 μm, scratch resistance is reduced to result in poor appearance and increase the occurrence of abrasion particles.

Additionally, in the fifth step, an energy source used for irradiating UV light may be any of various instruments known in the art, for example, a high-voltage mercury lamp, a halogen lamp, xenon lamp, nitrogen laser, etc, but is not limited thereto.

Also, the wavelength of the irradiated UV light is for example 300 nm to 400 nm, but is not limited thereto. The corresponding light quantity is for example, 50 mJ/cm$^2$ to 3,000 mJ/cm$^2$, but is not limited thereto.

Furthermore, the method for preparing the conductive flooring material according to the present invention may further comprise a sixth step of thermally compressing the conductive backing layer comprising carbon materials on the back side of the conductive deformation-preventing layer obtained in the first step.

The sixth step may be carried out after the first step, or any one step of the second to fifth steps. The time sequence carrying out the sixth step has no particular limitation within the scope for preparing the flooring material according to the present invention.

FIG. 1 is a process flow chart schematically illustrating a method for producing the conductive flooring material according to one embodiment of the present invention.

Referring to FIG. 1, in the method for preparing the flooring material according to an example of the present invention, conductive fibers (conductive G/fiber) consisting of a conductive deformation-preventing layer is impregnated in a polyvinyl chloride sol (PVC) to obtain the conductive deformation-preventing layer, as mentioned above.

Then, a conductive chip is scattered to obtain a conductive chip layer, in which embossing pattern is formed on the surface of the chip to embody various desirable appearances.

Meanwhile, as mentioned above, a different textile comprising carbon materials and a polymer resin is obtained by using a calendering process and the textile obtained is cut in the same size as that of the conductive deformation-preventing layer to be thermally compressed on the back side of the conductive deformation-preventing layer.

Thus, there is provided a flooring material having the conductive backing layer attached on the back side of the conductive deformation-preventing layer.

Additionally, a photocurable resin composition comprising conductive particles is coated on the conductive chip layer by using a known coating method, and then cured by carrying out UV irradiation.

The flooring material thus obtained is subjected to a winding-in process to prepare a conductive flooring material in the form of a long sheet, which is also obtained in the form of a tile type by carrying out a cutting process.

According to the present invention in some embodiments, it is possible to provide the conductive flooring material having good electrical conductivity and stable deformation-preventing properties as the conductive fibers comprised in the conductive deformation-preventing layer contains a glass fiber and a carbon fiber in an optimum amount to improve electrical conductivity and deformation-preventing properties.

Furthermore, the conductive flooring material according to the present invention can have surprisingly stable deformation-preventing properties to be easily prepared in the form of a long sheet type of which use is increased by consumers, as well as a tile type.

EXAMPLE

The present invention will be described in further detail with reference to examples according to the present invention and comparative examples not relating to the present invention. However, it should be understood that the present invention is not restricted by the specific Examples.

Example 1

69 parts by weight of a glass fiber, 9 parts by weight of a carbon fiber, 22 parts by weight of a pulp and 3 parts by weight of a binder were combined to obtain a conductive fiber textile having a thickness of 0.35 nm and a weight of 50 g/m$^2$. 100 parts by weight of polyvinyl chloride, 95 parts by weight of a plasticizer, 100 parts by weight of a filler and 10 parts by weight of an additive were combined to obtain a polyvinyl chloride sol, followed by impregnating to the conductive fiber textile, to form a conductive deformation-preventing layer.

Then, 15 parts by weight of a carbon chip which was obtained by cutting a compound containing 100 parts by weight of polyvinyl chloride, 50 parts by weight of a plasticizer, 100 parts by weight of a filler, 5 parts by weight of an additive and 15 parts by weight of conductive carbon having an average particle diameter of 0.5 μm in the form of granule chip having a size of 0.5 mm to 2.0 mm and 85 parts by weight of a colored chip which was obtained by cutting a compound containing 100 parts by weight of polyvinyl chloride, 50 parts by weight of a plasticizer, 100 parts by weight of a filler, 5 parts by weight of a colored dye and 5 parts by weight of an additive in the form of granule chip having a size of 0.5 mm to 2.0 mm were mixed to obtain a mixed chip, and then the mixed chip was coated on the conductive deformation-preventing layer. After gelling at a temperature of 200° C., a thermal compression process was carried out at a pressure of 7 kgf/cm$^2$, to integrally form a conductive chip layer on the conductive deformation-preventing layer.

Also, a resin composition obtained by mixing 100 parts by weight of polyvinyl chloride, 50 parts by weight of a plasticizer, 100 parts by weight of a filler, 10 parts by weight of an additive and 15 parts by weight of conductive carbon having an average particle diameter of 0.5 μm was rolled with a calendar, to obtain a conductive backing layer in the form of a sheet having a thickness of 0.7 mm.

The conductive backing layer was cut to have the same width as the conductive deformation-preventing layer, followed by attaching on the back side of the conductive deformation-preventing layer and thermally compressing by using a roller.

Then, a urethane acrylate-based conductive photocurable resin composition comprising 7 parts by weight of ethylene oxide and an ion complex was coated on the conductive chip layer, following by UV irradiation.

The resultant obtained was subjected to a winding-in process to prepare a conductive flooring material according to Example 1 in the form of a long sheet.

Comparative Example 1

The procedure of Example 1 was repeated except that a deformation-preventing layer consisting of 100% glass fibers was laminated instead of the conductive deformation-preventing layer of Example 1, to prepare a conductive flooring material according to Comparative Example 1.

Experimental Example

The flooring materials according to Example 1 of the present invention and Comparative Example 1 were measured for their physical properties by using the following methods.

1. Measurement of Electrical Conductivity

The electrical resistance of the flooring materials according to Example 1 and Comparative Example 1 was measured in accordance with JIS A 1454, and the results thereof are shown in Table 1.

TABLE 1

| | Surface Resistance | Volume resistance |
|---|---|---|
| Example 1 | $1.5 \times 10^5$ Ω | $2.5 \times 10^5$ Ω |
| Comparative Example 1 | $6.0 \times 10^9$ Ω | $4.5 \times 10^{10}$ Ω |

What is claimed is:

1. A conductive flooring material, comprising:

a conductive deformation-preventing layer comprising carbon fibers and glass fibers formed into conductive fibers, the carbon fibers in an amount of 3 parts by weight to 30 parts by weight based on 100 parts by weight of glass fibers, and the conductive fibers having polymer resin impregnated therein;

a conductive chip layer comprising carbon chips and colored chips formed on a top surface of the conductive deformation-preventing layer, the carbon chips present in an amount of 5 parts by weight to 30 parts by weight based on 100 parts by weight of the colored chips;

a conductive backing layer comprising a carbon material and a polymer resin formed on a bottom side of the conductive deformation-preventing layer, the carbon material present in an amount of 10 parts by weight to 300 parts by weight based on 100 parts by weight of the polymer resin, and the polymer resin includes polyvinyl chloride resin;

a UV coating layer comprising a photocurable resin and conductive particles formed on the conductive chip layer, the conductive particles having an average particle diameter ranging from 5 nm to 200 nm; and a conductive wax layer formed on the conductive chip layer different from the UV coating layer comprising a wax containing conductive particles, the conductive particles having an average particle diameter ranging from 5 nm to 200 nm.

2. The conductive flooring material of claim 1, which has an electrical resistance of $10^3$ to $10^{10}\Omega$.

3. The conductive flooring material of claim 1, which has a dimensional change ratio of 0.1% or less being measured after exposure to a temperature of 80° C. for 6 hours.

4. The conductive flooring material of claim 1, which is in the form of a long sheet type or a tile type.

5. The conductive flooring material of claim 1, wherein the conductive particles comprise micro-sized particles having conductivity selected from a group consisting of carbon nanotubes, antimony-doped tin oxide (ATO), indium-doped tin oxide (ITO), and antimony-doped zinc oxide (AZO).

6. The conductive flooring material of claim 1, wherein the carbon chips are conductive chips prepared by grinding a cured polymer resin comprising carbon and the colored chips include a certain color chip.

7. A method for producing a conductive flooring material, comprising:

forming a conductive deformation-preventing layer comprising carbon fibers and glass fibers formed into conductive fibers, and impregnating a polymer resin sol in the conductive fibers, the carbon fibers in an amount of 3 parts by weight to 30 parts by weight based on 100 parts by weight of glass fibers;

forming a conductive chip layer on a top surface of the conductive deformation-preventing layer by scattering a conductive chip on the conductive deformation-preventing layer and thermally compressing the scattered conductive chip; and forming a conductive backing layer comprising a carbon material and polymer resin on a bottom side of the conductive deformation-preventing layer and thermally compressing the conductive backing layer, the carbon material present in an amount of 10 parts by weight to 300 parts by weight based on 100 parts by weight of the polymer resin and the polymer resin comprising polyvinyl chloride resin;

forming a UV coating layer comprising a photocurable resin and conductive particles formed on the conductive chip layer, the conductive particles having an average particle diameter ranging from 5 nm to 200 nm; and forming a conductive wax layer formed on the conductive chip layer different from the UV coating layer comprising a wax containing conductive particles, the conductive particles having an average particle diameter ranging from 5 nm to 200 nm.

8. The method for producing the conductive flooring material of claim 7, further comprising:

coating a photocurable resin composition comprising conductive particles on the conductive chip layer; and curing the coated photocurable composition by UV-irradiating the coated photocurable composition.

* * * * *